US009010349B1

(12) United States Patent
Heacock

(10) Patent No.: US 9,010,349 B1
(45) Date of Patent: Apr. 21, 2015

(54) BOULDERING MAT AND TENT COMBINATION

(71) Applicant: Jason Heacock, Ossipee, NH (US)

(72) Inventor: Jason Heacock, Ossipee, NH (US)

( * ) Notice: Subject to any disclaimer, the term of this patent is extended or adjusted under 35 U.S.C. 154(b) by 0 days.

(21) Appl. No.: 14/283,740

(22) Filed: May 21, 2014

(51) Int. Cl.
*E04H 15/02* (2006.01)
*E04H 15/56* (2006.01)
*A63B 29/00* (2006.01)

(52) U.S. Cl.
CPC ..... *E04H 15/56* (2013.01); *E04H 15/02* (2013.01)

(58) Field of Classification Search
CPC ..... A45F 4/04; A45F 4/06; A63B 6/00; A63B 6/02; E04H 15/56; E04H 15/324
USPC ..... 5/417, 418, 420, 413 R; 135/95, 96, 135/116, 137; 224/154
See application file for complete search history.

(56) References Cited

U.S. PATENT DOCUMENTS

| | | | | | |
|---|---|---|---|---|---|
| 510,239 | A | * | 12/1893 | Carr | 224/154 |
| 1,624,797 | A | * | 4/1927 | Morehouse | 5/417 |
| 3,319,273 | A | * | 5/1967 | Solin | 5/420 |
| 3,751,741 | A | * | 8/1973 | Hendry | 5/413 AM |
| 4,271,856 | A | | 6/1981 | Ferguson | |
| 4,350,721 | A | * | 9/1982 | Nagase | 428/33 |
| 5,360,028 | A | | 11/1994 | Jasin | |
| 5,562,115 | A | | 10/1996 | Sotelo | |
| 5,642,750 | A | | 7/1997 | Brown | |
| 5,660,197 | A | | 8/1997 | Boe et al. | |
| 5,699,820 | A | * | 12/1997 | Evans et al. | 135/96 |
| 6,167,898 | B1 | | 1/2001 | Larga et al. | |
| 7,137,399 | B1 | | 11/2006 | Ransom et al. | |
| 2006/0185707 | A1 | | 8/2006 | Viglione | |
| 2013/0086744 | A1 | * | 4/2013 | Silverman | 5/420 |

OTHER PUBLICATIONS

REI Website, Kelty Cabana Tent, available at http://www.rei.com/product/808943/kelty-cabana-large (last visited Apr. 15, 2014).
Black Diamond Website, Mondo Crash Pad, available at http://blackdiamondequipment.com (last visited Apr. 11, 2014).

* cited by examiner

*Primary Examiner* — Robert Canfield
(74) *Attorney, Agent, or Firm* — Mesmer & Deleault PLLC

(57) ABSTRACT

A bouldering mat/tent combination includes a mat having a first mat member and a second mat member hingedly connected to the first mat member along a transverse seam so that the mat is convertible between an open mat position and a closed mat position. A first storage pouch is attached to or defined by the mat. A tent membrane member is disposable within the first storage pouch. The tent membrane can be releasably connected to the mat with one or more releasable fasteners.

16 Claims, 9 Drawing Sheets

BOULDERING MAT AND TENT COMBINATION

BACKGROUND OF THE INVENTION

1. Field of the Invention

The present invention relates generally to camping, hiking, and climbing. More particularly, the present invention relates to a climbing crash pad.

2. Description of the Prior Art

Rock climbers engage in a form of climbing known as bouldering, where the climber does not use ropes or harnesses. Compared to free solo climbing, which is also performed without ropes, the path that a climber takes in order to complete the bouldering climb is usually less than twenty feet tall. To protect oneself from injury, a bouldering climber may use a bouldering mat or "crash pad" positioned below the climbing location to absorb the impact of a fall. A crash pad is also used to cover dangerous sections of the ground below a chosen climb, such as protruding rocks or tufts of grass.

A bouldering mat or crash pad is available in various sizes, but commonly is a folded mat about three to four inches thick, that when unfolded, has a rectangular area of approximately three feet by four feet. A bouldering mat may include shoulder straps for easily moving it between bouldering sites and for carrying the bouldering mat on short hikes. Some bouldering mats have a dual-density or triple-density foam top portion that provides a different level of support compared to a softer bottom or middle portion. The higher-density foam at the top portion reduces the chance of injury by preventing the climber's foot from sinking through the foam and either gaining impact with the ground or becoming stuck in the mat.

One bouldering mat has a top layer of closed-cell polyethylene foam and a bottom layer of high-compression polyurethane foam. The bouldering mat has a first half and a second half that fold together along a middle fabric seam connecting the two halves across the top surface of the closed-cell foam. The bouldering mat also includes shoulder straps, grab handles, a waist belt, and metal buckles to retain the mat in a folded configuration. The mat has polyurethane-coated ripstop polyester on the bottom surface and side surfaces.

SUMMARY OF THE INVENTION

The bouldering mats of the prior art have several limitations and disadvantages. Although prior art bouldering mats may be useful as a bouldering mat, the size of these bouldering mats makes them unusuitable for other purposes. Particularly, the full, unfolded size of prior art bouldering mats (e.g., 3×4 feet) is generally too small to use as a sleeping mat except, perhaps, by children.

Also, bouldering mats of the prior art lack any storage pockets. When the user carries prior art bouldering mats using attached shoulder straps, the user's shoulders are occupied by the bouldering mat and therefore unavailable to carry a backpack. This requires the user to separately carry additional equipment to the bouldering site. Therefore, if the user wishes to take the bouldering mat on an overnight excursion, a tent, sleeping pad, and other equipment must be carried by hand, somehow strapped to the bouldering mat, or left behind. Strapping equipment to the bouldering mat creates a weight distribution that can be difficult to manage or is tiring to the user.

These deficiencies of prior art bouldering mats result in a need for an improved bouldering mat that converts between multiple sizes and includes one or more storage pouches where a tent and other equipment may be stored. The present invention overcomes these problems by providing a bouldering mat/tent combination that includes a mat convertible between various sizes and a tent membrane that can be stored in a storage pouch on the mat.

In one embodiment, a bouldering mat/tent combination includes a mat having a proximal end and a distal end. A first side portion and a second side portion opposite the first side portion extend between the proximal and distal ends. The proximal end, distal end, first side portion and second side portion define a perimeter sidewall extending between a first user surface (e.g., top surface) and a second user surface (e.g., bottom surface) opposite the first user surface. The mat has a first mat member and a second mat member. The second mat member is hingedly connected to the first mat member along a transverse seam so that the mat is convertible between an open mat position and a closed mat position. In the open mat position, the first mat member abuts the second mat member proximate the transverse seam with the first user surface extending along a first plane and with the second user surface extending in a second plane substantially parallel to and spaced apart from the first plane. In the closed mat position, the mat is folded on itself along the transverse seam so that the first user surface portion of the first mat member abuts a first user surface portion of the second mat member. One or more storage pouches is attached to or defined by the mat.

A first tent membrane member is disposable within the first storage pouch. The first tent membrane has a lower membrane edge portion corresponding to the first user surface of the mat. The tent also has a membrane opening portion corresponding to a plane transverse to the first user surface. A releasable fastener first portion is disposed along the lower membrane edge portion. A releasable fastener second portion is disposed along the first side portion, proximal end, and second side portion of the first mat member. The releasable fastener second portion complements and is connectable to the releasable fastener first portion, where the first tent membrane is capable of releasably connecting to the mat by engagement of the releasable fastener first portion with the releasable fastener second portion. In this way, the tent membrane can be attached to the mat and set up to partially or completely cover or enclose the mat.

In another embodiment, the first storage pouch is permanently attached to the mat, such as being attached to a portion of the perimeter sidewall of the mat. In one embodiment, the portion of the perimeter sidewall is on the proximal end. In other embodiments, the storage pouch(es) are attached to a side portion of the mat.

In yet another embodiment, the first storage pouch comprises a recess in the mat and a flexible closing structure, such as a flap or cover that extends over the recess and attaches to the mat. In one embodiment, the recess is a slot, a channel, an opening, a pocket, a groove, an overhang, a shelf, or a bevel.

In yet another embodiment, the mat is further convertible between the closed mat position and a second closed mat position. In the second closed mat position, the mat of the closed mat position is again folded on itself. In one embodiment, the second mat member is foldable on itself proximate a medial seam extending along the second mat member from the distal end towards the proximal end, where the second mat member has a second mat member first half and a second mat member second half. The first and second halves of the second mat member are abatable and releasably connectable to one another along the medial seam. In the second closed position, the second mat member first half may be disconnected from the second mat member second half so that the second mat member first half and the second mat member second half can each fold to abut the first mat member. The first mat member then folds on itself along the medial seam with the first mat member disposed folded between the second mat member first half and the second mat member second half. In one embodiment, the mat defines at least one overlapping seam portion along the medial seam.

In yet another embodiment, the bouldering mat/tent combination includes a pair of shoulder straps attached to the mat. In one embodiment, the pair of shoulder straps is releasably attached to the mat.

In yet another embodiment, the bouldering mat/tent combination includes at least one pair of tent pole receptors connected to the tent membrane or to the mat and at least one tent pole. Each tent pole has a first pole end and a second pole end and is sized to extend over the mat with the first pole end received in one of the pair of tent pole receptors and the second pole end received in the other of the pair of tent pole receptors. The tent pole engages the first tent membrane member to maintain the first tent membrane member in an open position with the first tent membrane member substantially enclosing or covering an open space.

In one embodiment, one of the pair of tent pole receptors is attached to the first side portion of the mat and the other one of the pair of tent pole receptors is attached to the second side portion of the mat. In another embodiment, one of the pair of tent pole receptors is attached proximate a first corner of the mat and the other one of the pair of tent pole receptors is attached proximate a second corner of the mat located diagonally opposite of the first corner of the mat.

In another embodiment, the bouldering mat/tent combination includes a first tent pole and a second tent pole. The first tent pole is configured to extend from a first tent pole receptor proximate a first corner of the mat to a second tent pole receptor proximate a second corner of the mat located diagonally opposite the first corner. The second tent pole is configured to extend from a third tent pole receptor proximate a third corner of the mat to a fourth tent pole receptor proximate a fourth corner of the mat located diagonally opposite the third corner.

In yet another embodiment, a second storage pouch is attached to or defined by the mat. For example, the first storage pouch is on the proximal end of the mat and the second storage pouch is on the distal end of the mat. A second tent membrane member is disposable within the second storage pouch and has a second lower membrane edge portion corresponding to the first user surface of the mat. The second tent membrane also has a second membrane opening portion corresponding to the plane transverse to the first user surface. A second releasable fastener first portion is disposed along the second lower membrane edge portion and a second releasable fastener second portion is disposed along the first side portion, distal end, and second side portion of the second mat member. The second releasable fastener second portion complements and is connectable to the second releasable fastener first portion, where the second tent membrane member is capable of releasably connecting to the mat by engagement of the second releasable fastener first portion with the second releasable fastener second portion. A third releasable fastener first portion is disposed along the membrane opening portion of the first tent membrane member and a third releasable fastener second portion is disposed along the second membrane opening portion of the second tent membrane member. Thus, the membrane edge portion of the first tent membrane member is releasably connectable to the second membrane edge portion of the second tent membrane member by engagement of the third releasable fastener first portion with the third releasable fastener second portion.

DETAILED DESCRIPTION OF THE PREFERRED EMBODIMENT

Figure 1:
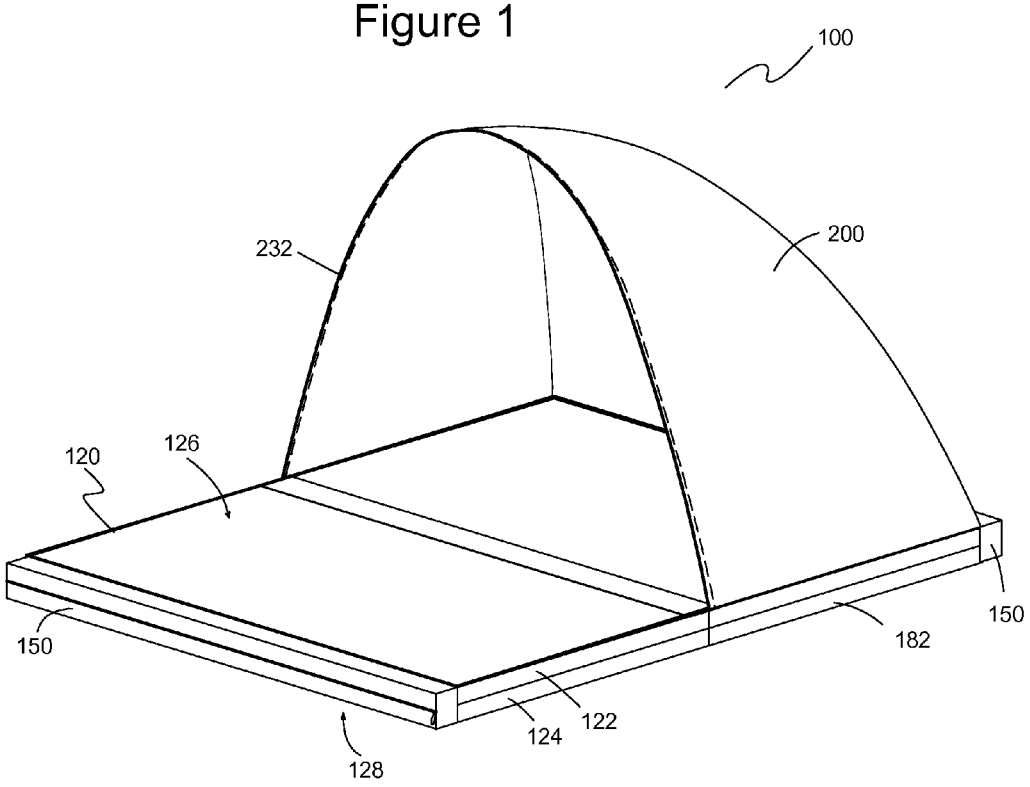
FIG. 1 illustrates a perspective view of one embodiment of a bouldering mat/tent combination of the present invention showing the mat in a camping configuration with a first tent membrane member in an open position.

The preferred embodiments of the present invention are illustrated in FIGS. 1-10. FIG. 1 illustrates one embodiment of a bouldering mat/tent combination 100 that includes a mat 120 with a first storage pouch 150 and a tent membrane 200 releasably connected to mat 120. Tent membrane 200 defines a tent opening 232. Bouldering mat/tent combination 100 is convertible between a hiking configuration having a size suitable for trail hiking, a larger "crash pad" or bouldering mat configuration with one or more storage pouch 150 and tent membrane 200 that can be separated from mat 120, and a still larger camping configuration where mat 120 has a tent mat size with tent membrane 200 set up and attached to mat 120 to provide shelter or shade while sleeping or relaxing. This versatility is made possible by features found in mat 120 and tent membrane(s) 200.

In one embodiment, mat 120 substantially defines a rectangular shape and has a first mat layer 122 and a second mat layer 124. First mat layer 122, preferably is made of open-cell foam about one inch in thickness. Other thicknesses are acceptable. First mat layer 122 has a principal surface or first user surface 126. First user surface 126 is typically the surface that the user would use for sleeping or resting due to the softness of open-cell foam. Second mat layer 124 has a second user surface 128 opposite first user surface 126. Second mat layer 124 is adhered to first mat layer 122 and preferably is made of closed-cell foam about one inch in thickness. Second user surface 128 typically is the surface that the user would position against the ground when bouldering mat/tent combination is used in the camping configuration due to the firmness of closed-cell foam that better shields the user from rocks, grass clumps, and other protruding objects. More or fewer mat layers may be included. When first may layer 122 and second may layer 124 each have a thickness of one inch, mat 120 in the fully open or camping configuration has a mat thickness of two inches.

Figure 2:
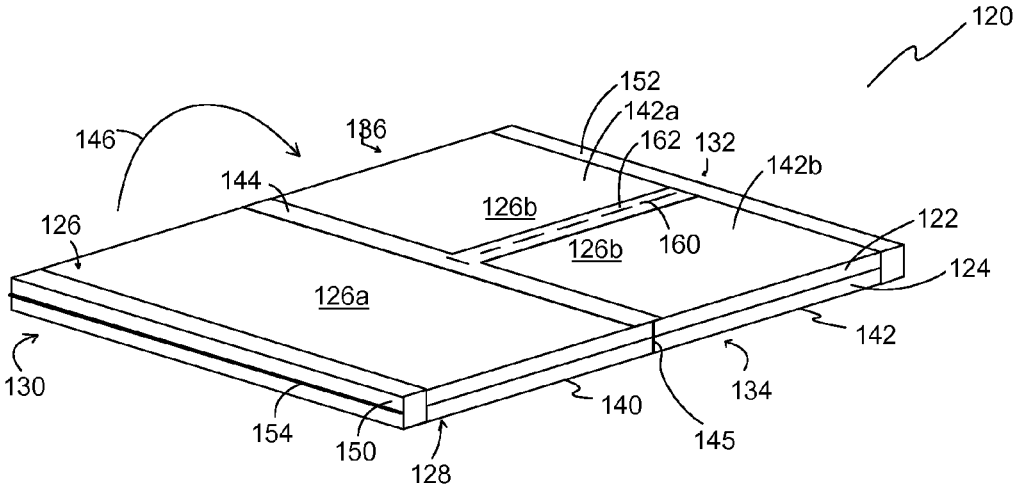
FIG. 2 illustrates a perspective view of a mat of FIG. 1 in the camping configuration and showing storage pouches, a hinge, and the second mat member.

Referring now to FIG. 2, a perspective view shows one embedment of mat 120 opened to the camping configuration. Mat 120 has a proximal end 130, a distal end 132 opposite proximal end 130, a first side portion 134 and a second side portion 136 opposite first side portion 134. Proximal end 130, distal end 132, first side portion 134, and second side portion 136 correspond to the ends or sides of the rectangular shape of mat 120 where distal end 132, first side portion 134, proximal end 130, and second side portion 136 define a sidewall 182 along the perimeter of mat where sidewall 182 extends between first user surface 126 and second user surface 128. Similarly, first user surface 126 and second user surface 128 correspond to the principal faces of a relatively flat rectangular shape. In one embodiment, mat 120 opened to the camping configuration has a size of approximately sixty-six inches from proximal end 130 to distal end 132, approximately forty-two inches from first side portion 134 to second side portion 136, and an overall thickness of about four inches. Mat 120 is not limited to these dimensions, but these dimensions have been found to be a useful size for the intended uses of bouldering mat/tent combination 120.

Mat 120 has a first mat member 140 and a second mat member 142 hingedly connected to first mat member 140 along a hinge 144 therebetween. In one embodiment, hinge 144 extends transversely (e.g., perpendicularly) from first side portion 134 to second side portion 136. In one embodiment, hinge 144 is a flexible connector made of fabric that extends between and connects first mat member to second mat member along a transverse seam 145. For example, hinge 144 is a strip of fabric affixed to first mat layer 122 by adhesive, stitching, or other means. In one embodiment, hinge 144 attaches to second mat layer 124 or to mat 120 between first mat layer 122 and second mat layer 124. In one embodiment, hinge is a strip of fabric, leather, or other flexible material attached to and connecting a cover 141 (shown partially in FIG. 7B) enclosing first mat member 140 and second mat member 142 (individually or together). Acceptable materials for hinge 144 include leather, plastic, woven or non-woven synthetic or natural fibers, and other flexible materials. In yet another embodiment, hinge 144 comprises one or more straps extending across transverse seam 145 between first mat member 140 and second mat member 142, whether directly connected to first and second mat members 140, 142 or attached to cover 141 on mat members 140, 142. Hinge 144 permits first mat member 140 to pivot relative to second mat member, such as when converting mat 120 to a closed mat configuration by folding first mat portion 140 onto second mat portion 142 in the direction of arrow 146 with first user surface 126 of first mat portion 140 abutting first user surface 126*b* of second mat portion 142.

Mat 120 includes a first storage pouch 150. In one embodiment, first storage pouch is on proximal end 130. Optionally, mat 120 also includes a second storage pouch 152. For example, second storage pouch 152 is on distal end 132. First and second storage pouches 150, 152 optionally can be located along first side portion 134 and/or second side portion. For example, first storage pouch 150 is attached along first side portion 134 of first mat member 140 and second storage pouch 152 is attached along first side portion 134 of second mat member 142. First storage pouch 150 and second storage pouch 152 are preferably symmetrical in shape and construction, but they may differ in shape, size, and/or construction to meet various storage needs. Since each of first storage pouch 150 and second storage pouch 152 each can be one of many embodiments, only the attributes of first storage pouch 150 are discussed where one or more of these attributes can be similarly applied to second storage pouch 150.

Figure 2A:
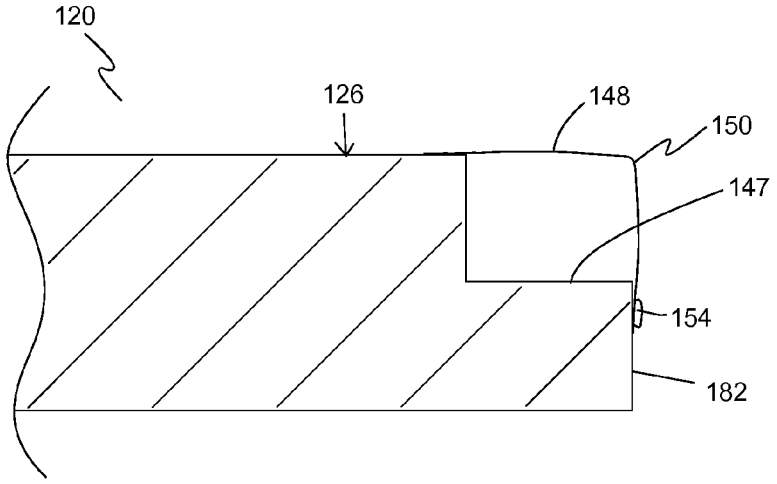
FIG. 2A illustrates a partial, side sectional view of a portion of one embodiment of a mat of the present invention showing an recess and closing structure that define a storage pouch.

In one embodiment, first storage pouch 150 is a fabric pocket or enclosure connected or attached to proximal end 130 of mat 120. Typically, first storage pouch 150 is permanently attached to mat 120. For example, first storage pouch 150 is fixedly attached to proximal end 130 by using adhesives, stitching, solvent welding, heat fusion, or other techniques. In other embodiments, first storage pouch 150 is a separate component that is attachable to mat 120, is part of a cover 141 enclosing first mat member 140 or mat 120, is connected to cover 141, or the like. In yet another embodiment, first storage pouch 150 comprises a recess 147, cutout, slot, overhang, shelf, opening, void, or other structure in mat 120 that defines first storage pouch 150 together with a closing structure 148, such as a cover, flap, fabric panel, wall, or the like. Recess 147 and closing structure 148 together complete an enclosure. FIG. 2A illustrates a sectional side view of part of mat 120 with a recess 147 and closing structure 148 that define first storage pouch 150. Closing structure 148 in one embodiment is piece of fabric or other flexible material that is attached to first user surface 126 and that releasably attaches to sidewall 182 using a snap or other closure 154.

Figure 2B:
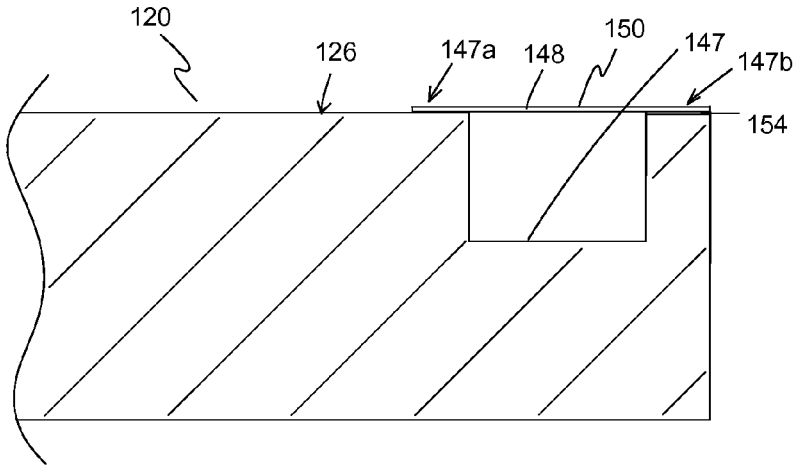
FIG. 2B illustrates a partial, side sectional view of a portion of another embodiment of a mat of the present invention showing a slot-like recess and closing structure that define a storage pouch.

FIG. 2B shows a sectional side view of part of mat 120 where recess 147 is a slot in mat 120. Together with closing structure 148, such as a fabric flap, recess 147 defines first storage pouch 150. As shown in FIG. 2B, for example, closing structure 148 is affixed to first user surface 126 on one side 147*a* of recess 147 and can be releasably attached to first user surface 126 on the other side 147*b* of recess 147 with a closure 154, such as a hook-and-loop fastener.

First storage pouch 150 extends substantially along the entire proximal end 130 of mat 120. First storage pouch 150 typically has a closure 154 extending along all or most of the width of proximal end 130. Closure in one embodiment is a zipper, overlapping flaps with hook-and-loop connectors, fold-over flaps, snaps, buttons, or other closure. When first storage pouch 150 is part of cover 141, first storage pouch 150 preferably defines a discrete enclosure that is separate from that for first mat member 140. For example, a partition in cover 141 separates the storage space of first storage pouch 150 from the space occupied by first mat member 140. However, in some embodiments, first storage pouch 150 simply comprises excess space in cover 141 that is not occupied by first mat member 140.

Still referring to FIG. 2, in one embodiment of bouldering mat/tent combination 100, second mat member 142 comprises a second mat member first half 142*a* and a second mat member second half 142*b* that are releasably attachable to one another in abutment along a medial seam 160. it is contemplated that second mat member first half 142*a* does not have to be equal in size to second mat member second half 142*b*.

Figure 2C:
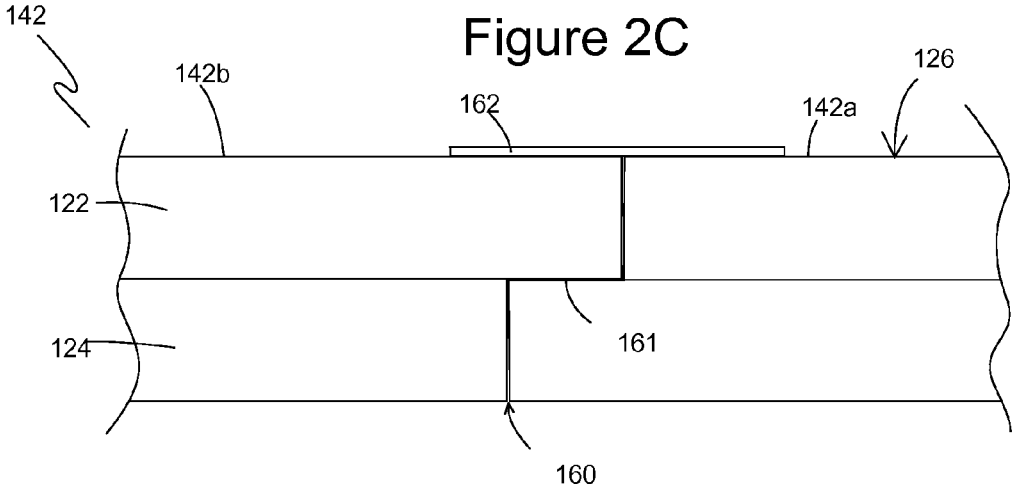
FIG. 2C illustrates a partial end view of first and second halves of the second mat member of FIG. 2 showing the first and second halves abutting at a medial seam where the medial seam has an overlapping seam portion.
Figure 2D:
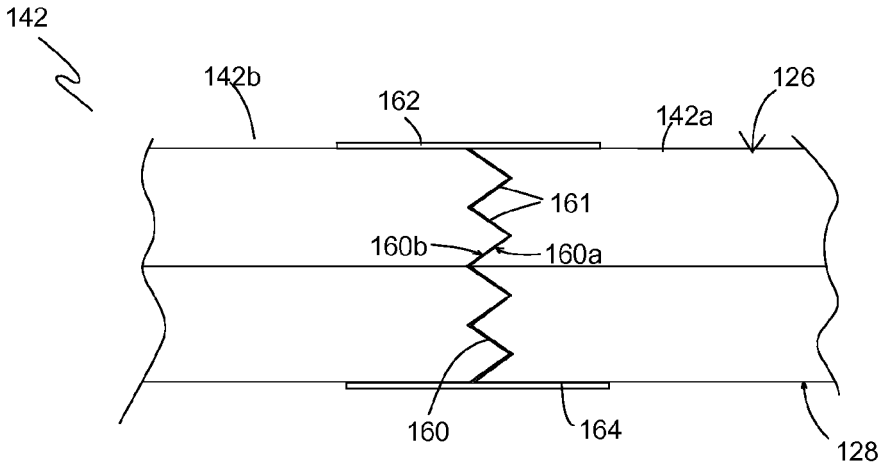
FIG. 2D illustrates a partial end view of first and second halves of second mat member of FIG. 2 showing the first and second halves abutting at a medial seam where the medial seam has a zig-zag shape with a plurality of overlapping seam portions.

Referring to FIGS. 2C and 2D, an end view of second mat member 142 shows optional embodiments of medial seam 160 between second mat member first half 142*a* and second mat member second half 142*b*. To provide additional stability to mat 120 when a user steps directly on medial seam 160, medial seam 160 optionally includes one or more overlapping seam portions 161. Overlapping seam portions 161 can be an offset assembly of first mat layer 122 and second mat layer 124 as shown in FIG. 2C. Here, first mat layer 122 overhangs second mat layer 124 on second mat member second half 142*b*. Similarly, first mat layer 122 forms a shelf or extends from below second mat layer 124 on second mat member first half 142*a*. Overlapping seam portions 161 can also be formed by a zig-zag profile of medial surfaces 160*a*, 160*b* as shown in FIG. 2D. Of course, medial seam 160 can simply be formed by abutting blunt medial surfaces 160*a*, 160*b* that do not overlap, similar to abutting adjacent rectangular blocks of material.

Figure 2E:
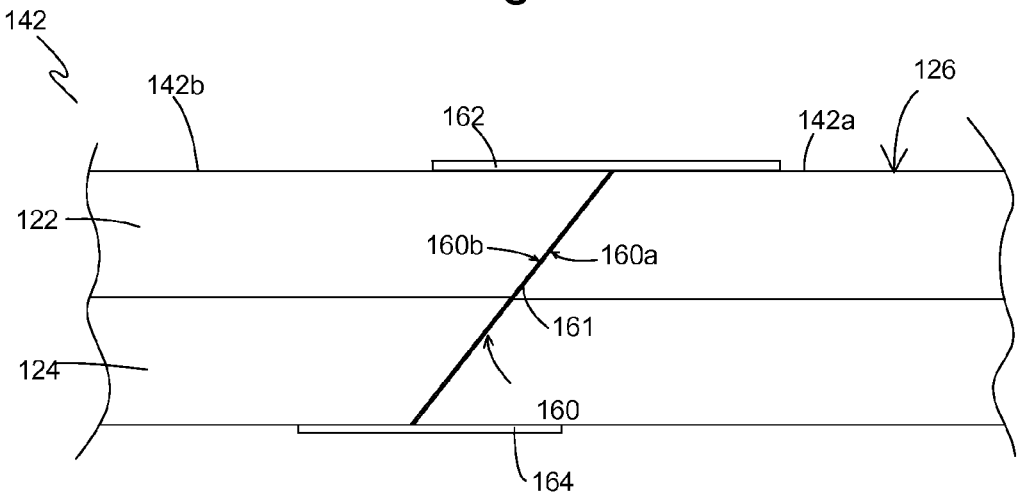
FIG. 2E illustrates a partial end view of first and second halves of second mat member of FIG. 2 showing the first and second halves abutting at a medial seam where each half of the second mat member has a beveled edge that define an overlapping seam portion.

FIG. 2E illustrates a partial end view of first and second halves of second mat member 142 shown abutting at a medial seam 160 where each half 142*a*, 142*b* of second mat member 142 has a beveled edge that define an overlapping seam portion 161.

As also illustrated in FIGS. 2C, 2D, and 2E, a connector flap 162 extends along medial seam 160 and releasably connects second mat member first half 142*a* to second mat member second half 142*b* at first user surface 126 (e.g., adjacent open-cell foam). Optionally, a second connector flap 164 (or continuation of connector flap 162) extends along medial seam 160 and releasably connects second mat member first half 142*a* to second mat member second half 142*b* at second user surface 128 (e.g., adjacent closed-cell foam). Connector flap 162 and second connector flap 164 (when present) preferably connect using a hook-and-loop fastener, snaps, hooks, buttons, or the like. In one embodiment, connector flap 162 is fixedly attached to second mat member 142 and functions like hinge 144 discussed above. In yet another embodiment, abutting medial surfaces 160*a*, 160*b* on second mat member first half 142*a* and second mat member second half 142*b*, respectively, additionally or alternately have adhered thereto mating portions of a hook-and-loop fastener strip. Accordingly, second mat member first half 142*a* and second mat member second half 142*b* are prone to remain attached to one another until separated, for example, for conversion to the further closed mat position, which is discussed below with reference to FIG. 4.

Figure 3:
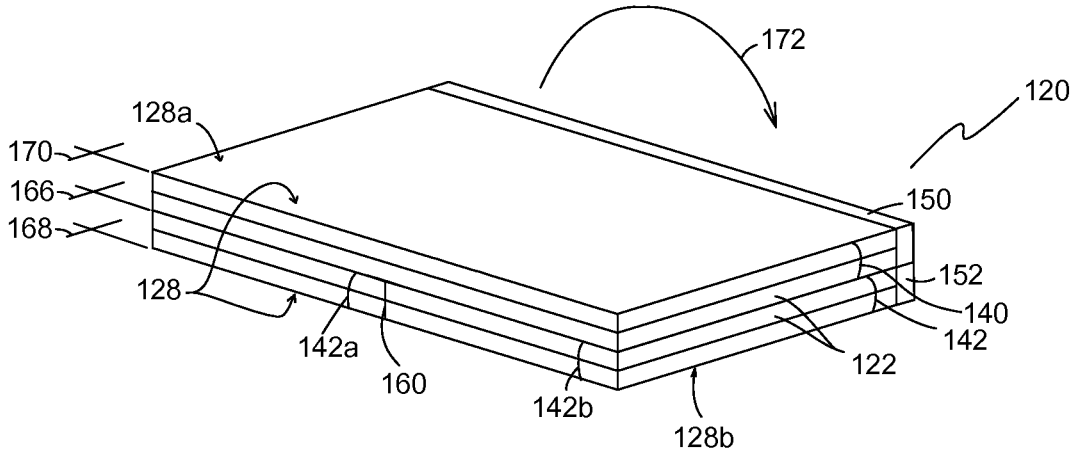
FIG. 3 illustrates a perspective view of the mat of FIG. 1 showing a mat folded to an intermediate size for use as a bouldering mat or "crash pad."

Referring now to FIG. 3, a perspective view illustrates mat 120 in a closed mat configuration or "crash pad" configuration with first mat member 140 folded onto second mat member 142. First user surface 126 of first mat portion 140 abuts first user surface 126*b* of second mat portion 142. First and second mat members 140, 142 have the same size as they do in the camping configuration of FIG. 2, but the overall size of mat 120 is smaller in the closed mat configuration since first and second mat members 140, 142 now are folded one on top of the other with first and second storage pouches 150, 152 aligned and abutting.

In the closed mat configuration, second user surface 128 is now split between the top and bottom surfaces of mat 120 with first user surface 126 positioned therebetween. That is, first user surface 126 folds on itself and extends substantially along a first plane 166. Second user surface 128 extends along a second plane 166 and along a third plane 168 substantially parallel to and spaced apart from second plane 166. First plane 166 is substantially parallel to and spaced between second plane 166 and third plane 168.

If present, medial seam 160 of second mat member 142 is positioned vertically below first mat member 140. This orientation provides a more rigid second mat layer 124 positioned to absorb impact of a falling climber and to disperse impact forces to layers of softer first mat layer 122 sandwiched therebetween. Also, with medial seam 160 positioned below first mat member 140, mat 120 maintains a continuous surface along third plane 170 (e.g., top surface with second user surface portion 128*a*) that avoids the user's foot or other part becoming lodged in a seam. For convenience in trail hiking and transporting bouldering mat/tent combination 100, mat 120 converts further to the second closed mat configuration by folding mat 120 on itself along medial seam 160 in a direction shown by arrow 172.

Figure 4:
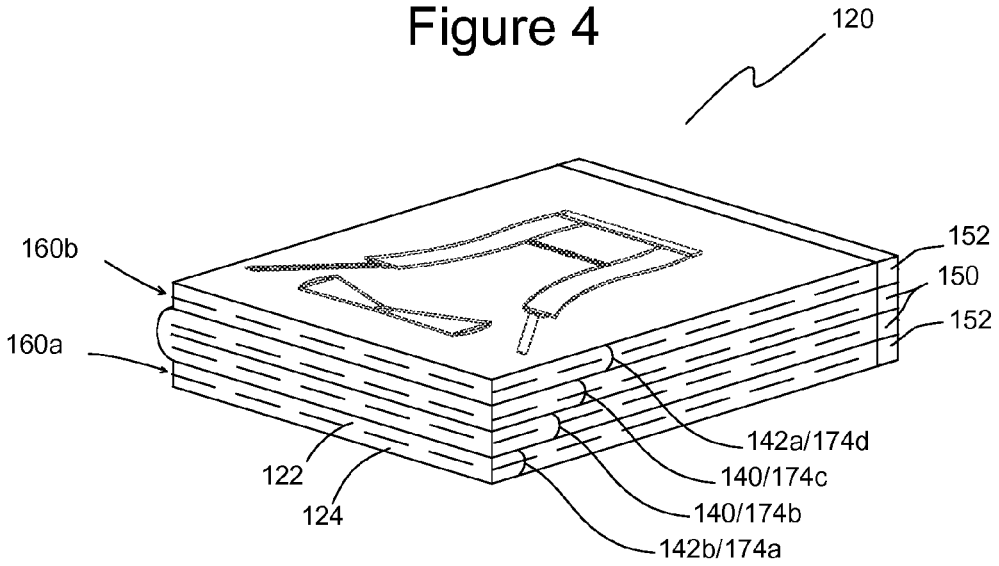
FIG. 4 illustrates a perspective view of the mat of FIG. 3 showing the mat converted to a backpack size and including shoulder straps and a waist belt.

Referring now to FIG. 4, a perspective view of mat 120 is shown converted to a second closed mat configuration. Mat 120 is folded or bent with second user surface portion 128*a* (e.g., top surface, shown in FIG. 3) folded onto and abutting itself. In the second closed mat configuration, mat 120 has an overall area that is approximately half of the overall area of mat 120 in the closed mat configuration, but is twice as thick. For clarity, the interface between first mat layer 122 and second mat layer 124 is shown in broken lines in FIG. 4. When mat 120 includes a medial seam 160 (shown in FIGS. 2-3), abutting medial surfaces 160*a* 160*b* disengage when mat 120 is folded to the second closet mat configuration. This allows for easier folding since only first mat member 140 is folded. Therefore, in the second closed mat configuration, mat 120 has four main layers that include second mat member second half 142*b* (e.g., bottom layer 174*a*), first mat member 140 (e.g., lower middle layer 174*b*), first mat member 140 (e.g., upper middle layer 174*c*), and second mat member first half 142*a* (e.g., top layer 174*d*). Each layer 174*a*-*d* includes first mat layer 122 and second mat layer 124. First and second storage pouches 150, 152 are aligned and overlap one another.

Figure 5:
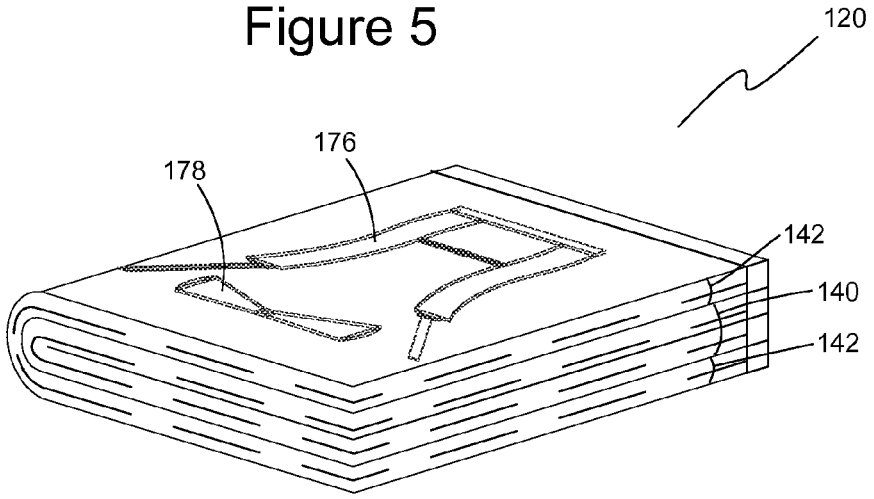
FIG. 5 illustrates a perspective view of another embodiment of a mat of the present invention showing the mat converted to a backpack size.

Referring now to FIG. 5, another embodiment of mat 120 is shown in the second closed mat configuration. Here, mat second member 142 is a single member that is not split into mat second member first half 142*a* and mat second member second half 142*b* and therefore lacks medial seam 160. Accordingly, when mat 120 is folded to the second closed mat configuration, both of first mat member 140 and second mat member 142 bend to fold second user surface portion 128 on itself. Mat first member 140 is folded and sandwiched between folded mat second member 142.

As also shown in FIG. 5, embodiments of mat 120 preferably include optional shoulder straps 176 and an optional waist belt 178. Shoulder straps 176 and waist belt 178 may be permanently attached to mat 120 or may be releasably attached to mat 120 using straps and strap connectors or other means known in the art.

Figure 6:
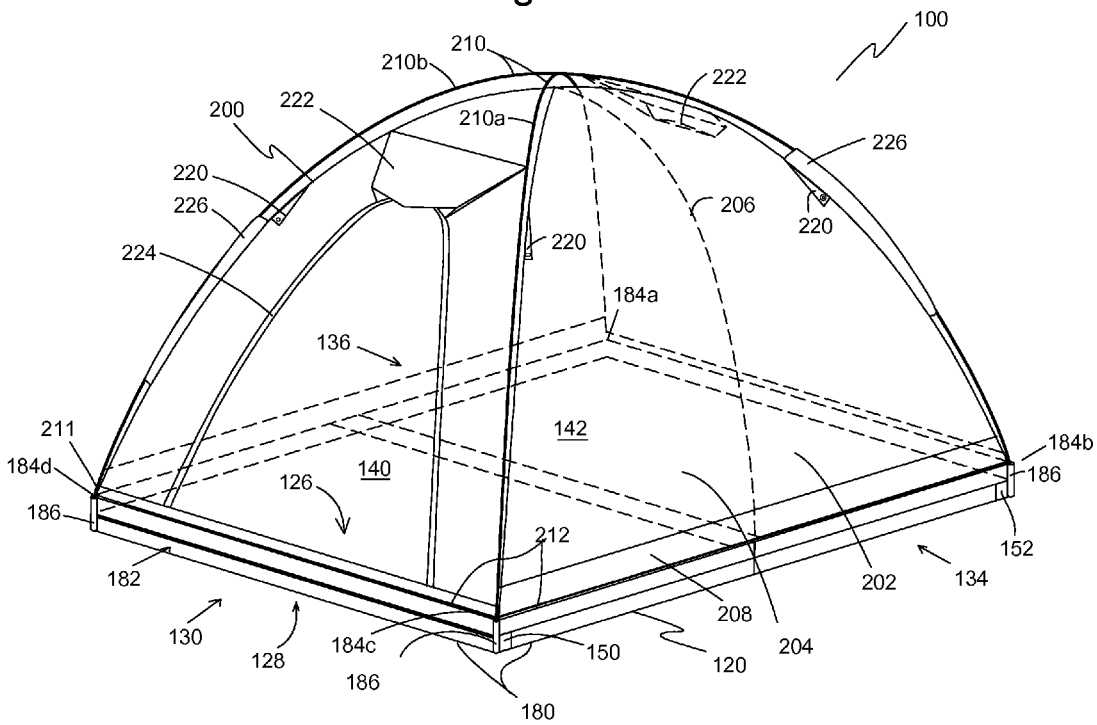
FIG. 6 illustrates a perspective view of another embodiment of a bouldering mat/tent combination of the present invention showing a tent membrane fully covering the mat and including tent poles extending between opposite diagonal corners.

Referring now to FIG. 6, a perspective view shows one embodiment of bouldering pad/tent combination 100 with tent membrane 200 releasably attached to mat 120 and supported in an open position with tent poles 210. In one embodiment, tent membrane 200 includes a first tent membrane member 202 and a second tent membrane member 204 that zip together or otherwise releasably attach along a tent membrane seam 206 extending transversely from first side portion 134 towards second side portion 134 of mat 120. In one embodiment, tent membrane seam 206 divides tent membrane 200 into two substantially equal halves that are first tent membrane member 202 and second tenet membrane member 204. In other embodiments, however, tent membrane seam 206 divides tent membrane 200 into unequal portions.

Tent membrane 200 has a lower membrane edge portion 208 extending along a membrane perimeter 212 corresponding to a mat perimeter 180. As shown in FIG. 6, membrane perimeter 212 is sized to extend along proximal end 130, first side portion 134, distal end 132, and second side portion 136. A releasable fastener 214 (shown in FIG. 7) connects lower membrane edge portion 208 to mat 120. Releasable fastener 214 can be one or more of a hook-and-loop fastener (e.g., Velcro®)), snaps, buttons, a zipper, or other fastener. Releasable fastener 214 has a first fastener portion 214*a* (e.g., hook portion of hook-and-loop fastener) and a second fastener portion 214*b* (e.g., loop portion of hook-and-loop fastener). First fastener portion 214*a* is attached to lower membrane edge portion 208 of tent membrane 200. Second fastener portion 214*b* is attached to mat 120 along mat perimeter 180. Second fastener portion 214*b* in one embodiment is attached to sidewall 182 of mat 120 (or cover 141) proximate the intersection between sidewall 182 and first user surface 126.

For example, releasable fastener 214 is a continuous strip or a plurality of strips of hook-and-loop fastener where the hook portion is fixed to sidewall 182 of mat 120. As another example, releasable fastener 214 is a zipper or plurality of zippers where one zipper half extends along mat perimeter 180 and the other zipper half extends along lower membrane edge portion 208 of tent membrane 200. Bouldering mat/tent combination 100 in some embodiments includes more than one type of releasable fastener 214. For example, a hook-and-loop fastener is used along first user surface 126 adjacent mat perimeter 180 and snaps are used along sidewall 182 of mat 120. Accordingly, tent membrane 200 optionally includes one or more flaps 230, straps, or other structure at lower membrane edge portion that enables attachment of tent membrane 200 to different surfaces of mat 120.

Figure 7A:
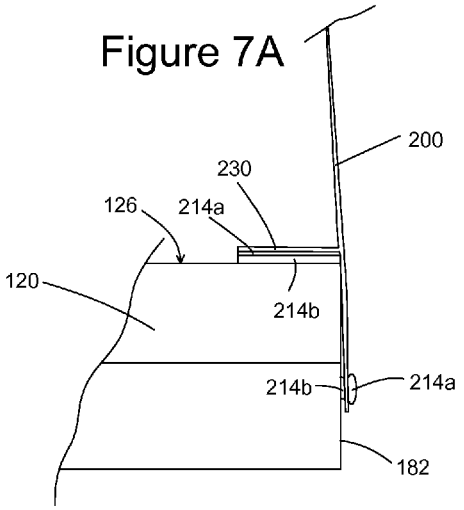
FIG. 7A illustrates a close-up elevational view of a portion of one embodiment of a tent membrane and mat showing attachment of the tent membrane to the mat.

FIG. 7A illustrates a close-up view of part of mat 120 and tent membrane 200 showing an example of releasable fasteners 214 used to connect tent membrane 200 to mat 120. As shown here, tent membrane 200 includes flap 230 with attached first fastener portion 214*a* of a hook-and-loop fastener that engages second fastener portion 214*b* fixed to first user surface 126 of mat 120. Tent membrane 200 also includes snaps with first fastener portion 214*a* engaging second fastener portion 214 attached to sidewall 182 of mat 120.

Figure 7B:
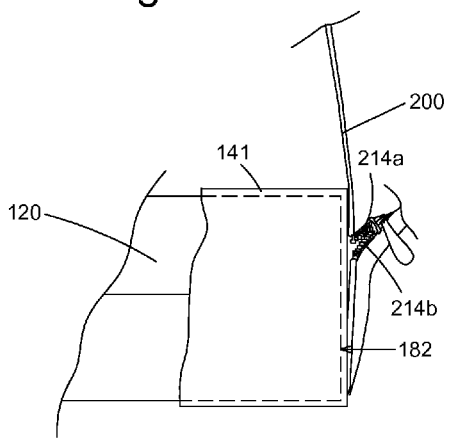
FIG. 7B illustrates a close-up, partial cutaway, elevational view of another embodiment of a tent membrane and mat with cover showing a zipper attachment between the tent membrane and a cover.

FIG. 7B illustrates a close-up, cutaway view of part of mat 120 with a cover 141 enclosing mat 120. Releasable fastener 214 is a zipper, where first fastener part 214*a* is attached to tent membrane 200 and second fastener part 214*b* is attached to cover 141. When cover 141 is not present, second fastener part 214*b* is preferably attached directly to sidewall 180 of mat 120.

Still referring to FIG. 6, tent membrane 200 is preferably sized to completely enclose and/or cover first user surface 126 of mat 120. If a smaller tent membrane 200 is used, or only first tent membrane member 202 is used, for example, only a portion of mat 120 is enclosed or covered as illustrated in FIG. 1. Since it is releasably attachable to mat 120, tent membrane 200 is also sized to be stowed in first and/or second storage pouch(es) 150, 152.

Tent membrane 200 optionally includes one or more additional features, such as an anchor attachment point 220, a vent 222, a door/window 224, or other features. Optionally, tent membrane 200 includes a floor portion 228 that extends between opposite lower membrane edge portions 208 and covers first user surface 126 of mat 120 or covers the ground. With floor portion 228, tent membrane 200 can be separated from mat 120 and left behind as an enclosure to protect the user's equipment while the user takes mat 120 and uses it for bouldering. Without floor portion 228, tent membrane 200 still may be set up and used separately from mat 120 and optionally includes a strap or other structure between opposite tent pole ends 211 to maintain pole 210 at tension without distorting the shape of the enclosure defined by tent membrane 200.

In one embodiment, tent membrane 200 is maintained in an open position by securing a rope to anchor attachment point(s) 220 and a tree, rock, or other object. As mentioned above, other embodiments of bouldering mat/tent combination 100 include at least one tent pole 210 that engage tent membrane 200 and maintain it in an open position. In one embodiment, a tent pole 210 extends substantially along or proximate to tent membrane seam 206 to maintain tent membrane 200 in an open position. Additional tent poles 210, a rope secured to anchor attachment points 220, or other support method optionally can be used in addition to tent pole 210 extending along tent membrane seam 206.

In another embodiment, a first tent pole 210*a* extends from a location proximate a first corner 184*a* to a location proximate a third corner 184*c* of mat 120 located diagonally opposite first corner 184*a*. A second tent pole 210*b* extends from a location proximate a second corner 184*b* to a location proximate a fourth corner 184*d* located diagonally opposite second corner 184*b*. Ends 211 of tent poles 210 optionally insert into pole receptors 186 located at corners 184*a-d* or at other locations on mat perimeter 180 or tent membrane 200. Pole receptors 186 can be fixed to tent membrane 200, to mat 120, or both. Pole receptors 186 are a sleeve, grommet, opening, recess, pocket, fold, or other structure that accepts end 211 of tent pole 210.

In one embodiment, tent membrane 200 includes a plurality of tent pole sleeves 226 extending from tent membrane 200 and defining a through-passageway for a tent pole 210. Tent pole 210 extends through tent pole sleeves 226 with ends 211 in pole receptors 186 to maintain tent poles 210 at tension in an arcuate shape that suspends tent membrane 200 in an open position. Clips, hooks, straps, loops, or other devices can be additionally or alternately used to connect tent membrane 200 to tent poles 210.

Tent poles 210 in one embodiment are segmented and collapsible to a size that each may be stowed in one of first storage pouch 150 or second storage pouch 152.

Optionally, tent membrane 200 is attached removably or permanently to an inside portion of first and/or second storage pouch 150, 152. In one embodiment, first storage pouch 150 is located on proximal end 130 of mat 120 where, for example, a part of lower membrane edge portion 208 corresponding to proximal end is fixed within first storage pouch 150 by stitching, adhesive, or other means.

Figure 8:
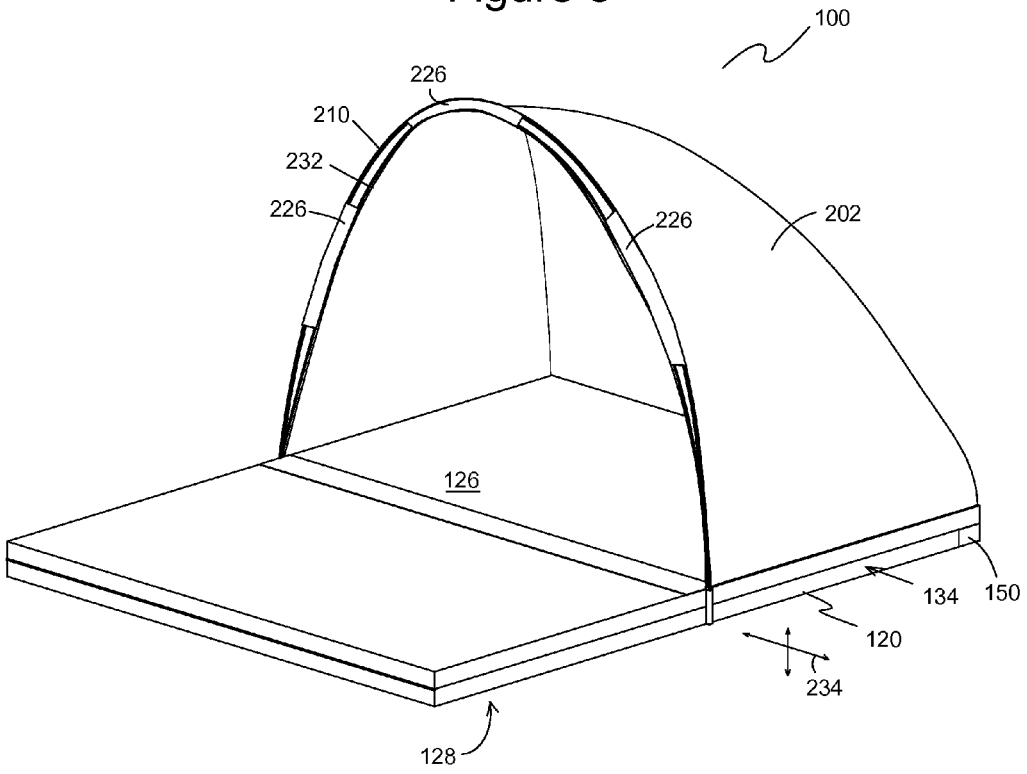
FIG. 8 illustrates a perspective view of another embodiment of the bouldering mat/tent combination of the present invention showing the combination with a first tent membrane member and the mat in an open position

Referring now to FIG. 8, another embodiment is shown of bouldering mat/tent combination 100. In this embodiment, tent membrane 200 includes a first tent membrane member 202. First storage pouch 150 is partially defined by a recess or overhang in mat 120. Bouldering mat/tent combination 100 includes a tent pole 210 adapted to extend along a tent opening 232 (also shown in FIG. 1) of first tent membrane member 202 where tent opening 232 defines a tent opening plane 234 transverse (e.g., perpendicular) to first user surface 126 and second user surface 128 (not visible). For example, tent pole 210 extends through tent pole sleeves 226 from first side portion 134 towards second side portion 136 of mat 120. In this embodiment, a single tent pole 210 may be sufficient to maintain first tent membrane member 202 in an open position that defines a partially-enclosed area with tent opening 232. In this configuration, mat 120 is usable in its camping configuration where part of mat 120 is not covered by first tent membrane member 202 as shown. Alternately, the user has the option to fold first mat member 140 towards first tent membrane member 202 and onto second mat member 142 with first user surface 126 folded on itself. Accordingly, the user would have a thicker variation of mat 120 with a more rigid top surface that is second user surface 128 of first mat member 140. The user may use this variation, for example, as covered seating or a workstation.

Figure 9:
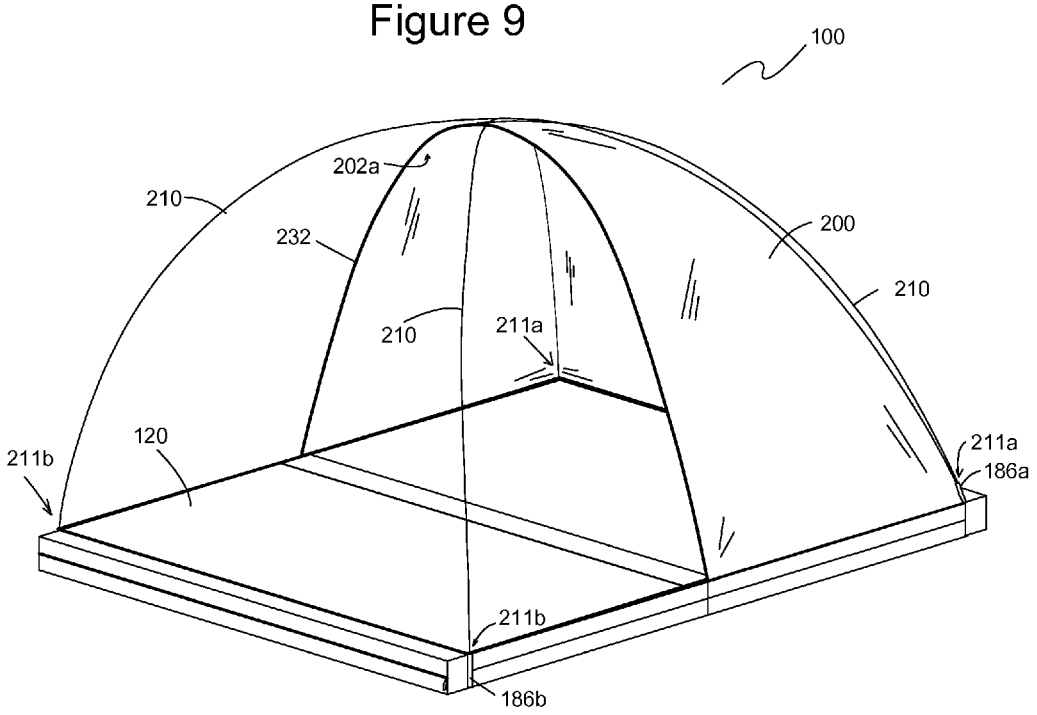
FIG. 9 illustrates a perspective view of another embodiment of the bouldering mat/tent combination of the present invention showing the combination with a tent membrane covering part of the mat and with tent poles extending from locations proximate opposite diagonal corners of the mat.

Referring now to FIG. 9, one embodiment of bouldering mat/tent combination 100 is shown with mat 120 in the open position and first tent membrane member 202 supported by tent poles 210 extending diagonally over mat 120 from locations proximate opposite corners of mat 120. A first tent pole end 211*a* of each tent pole 210 ends in a tent pole receptor 186*a* attached to first tent membrane member 202. A second tent pole end 211*b* end of each tent pole 210 is received in a tent pole receptor 186*b* attached to mat 120. Although tent poles 210 are shown in FIG. 9 as extending on the outside of first tent membrane member 202, it is contemplated that tent poles 210 may instead extend along the inside surface 202*a* or through enclosed region of tent membrane member 202.

Figure 10:
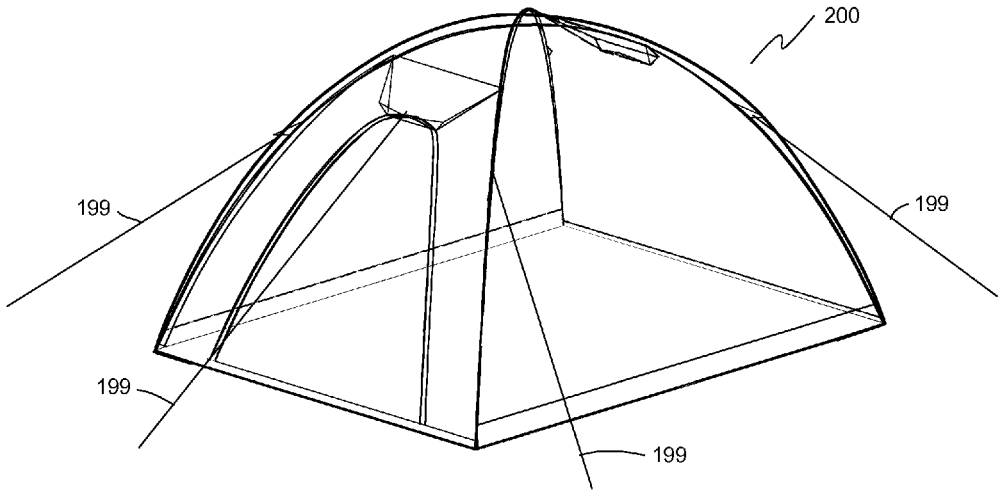
FIG. 10 illustrates a perspective view of one embodiment of a tent membrane of the present invention showing the tent membrane set up for use separately from the mat.

Referring now to FIG. 10, tent membrane 200 is shown set up by itself without mat 120. Tent membrane 200 is secured to the ground with guy wires 199 made of rope, string, or other suitable material. Where top surface of mat 120 in some cases forms the floor of tent membrane 200, as shown in FIG. 10, tent membrane 200 is used separately from mat 120 where tent membrane 200. Thus, tent membrane 200 in some embodiments allows for use as a floor-less tent. In other embodiments where tent membrane 200 includes a floor, the floor of tent membrane 200 can be set on mat 120 with tent membrane 200 attached to mat 120 as discussed above. This flexibility allows the user to take mat 120 to another site for bouldering or other activities.

Bouldering mat/tent combination 100 can be used for a variety of functions. Since mat 120 folds between a backpack size (shown in FIGS. 4-5), an intermediate crash pad size (shown in FIGS. 3 & 8), and a larger camping size (shown in FIGS. 1, 2, & 6), mat 120 can be sized for trail hiking as well as being useful as a sleeping surface, a sitting/resting surface, and a bouldering mat or crash pad. With one or more storage pouches 150, 152, a tent membrane 200, tent poles 210, and other equipment can be stored for a complete tent setup that includes a mat 120. In the larger, open configuration shown in FIGS. 1, 2, & 6, mat 120 additionally can be used as a large-size crash pad.

In use, the user may hike to a destination with bouldering mat/tent combination 100 in the backpack size and attached to the user's back using optional shoulder straps 176 and optional waist belt 178. Tent membrane 200 and tent pole(s) 210 are stored in first storage pouch 150 and/or second storage pouch 152. Upon arriving at the destination, the user converts mat 120 to the intermediate crash pad size or to the larger camping configuration, depending on the desired use. If desired, the user can set up tent membrane 200 by removing it from first storage pouch 150 and by installing tent poles 210 that are stored in second storage pouch 152. Tent membrane 200 may be attached to mat 120 for sleeping, camping, or other activities. Alternately, the user may leave behind tent membrane in its open, set-up position and take mat 120 to a bouldering site. At the bouldering site, mat is converted to the intermediate crash pad size for use as a bouldering mat with second user surface (e.g., closed-cell foam) 128 as the top and bottom surfaces. Upon returning to the destination or campsite, the user may attach tent membrane 200 to mat 120 for sleeping, resting, sitting, or other activities. The user optionally can use anchor attachment points 220 to secure tent membrane 200 or to maintain tent membrane 200 in an open configuration.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A bouldering mat/tent combination comprising:

a mat having a proximal end, a distal end, a first side portion, a second side portion opposite the first side portion, a first user surface, and a second user surface opposite the first user surface, wherein the proximal end, the first side portion, the second side portion, and the distal end define a perimeter sidewall extending between the first user surface and the second user surface, the mat comprising:

a first mat member;

a second mat member hingedly connected to the first mat member wherein the mat is convertible between (i) an open mat position with the first mat member abutting the second mat member along a transverse seam and (ii) a closed mat position with the mat folded on itself along the transverse seam with a first user surface first portion abutting a first user surface second portion; and a first storage pouch attached to the mat;

a first tent membrane member disposable within the first storage pouch, the first tent membrane having a lower membrane edge portion corresponding to the first user surface of the mat and a membrane opening portion corresponding to a plane transverse to the first user surface;

a releasable fastener first portion disposed along the lower membrane edge portion; and a releasable fastener second portion attached to the mat proximate the first side portion, proximal end, and second side portion of the first mat member, the releasable fastener second portion complementing and connectable to the releasable fastener first portion, wherein the first tent membrane is capable of releasably connecting to the mat by engagement of the releasable fastener first portion with the releasable fastener second portion.

2. The combination of claim 1, wherein the first storage pouch is permanently attached to a portion of the perimeter sidewall.

3. The combination of claim 1, wherein the first storage pouch comprises a recess in the mat and a flexible closing structure extending over the recess and attached to the mat.

4. The combination of claim 3, wherein the recess is selected from the group consisting of a slot, a channel, an opening, a pocket, a groove, an overhang, a shelf, and a bevel.

5. The combination of claim 2, wherein the portion of the perimeter sidewall is on the proximal end of the mat.

6. The combination of claim 1, further comprising:

a second storage pouch attached to the mat;

a second tent membrane member disposable within the second storage pouch and having a second lower membrane edge portion corresponding to the first user surface and a second membrane opening portion corresponding to the plane transverse to first user surface;

a second releasable fastener first portion disposed along the second lower membrane edge portion;

a second releasable fastener second portion disposed along the first side portion, distal end, and second side portion of the second mat member, the second releasable fastener second portion complementing and connectable to the second releasable fastener first portion, wherein the second tent membrane member is capable of releasably connecting to the mat by engagement of the second releasable fastener first portion with the second releasable fastener second portion;

a third releasable fastener first portion disposed along the membrane opening portion of the first tent membrane member; and a third releasable fastener second portion disposed along the second membrane opening portion of the second tent membrane member, wherein the membrane edge portion of the first tent membrane member is releasably connectable to the second membrane edge portion of the second tent membrane member by engagement of the third releasable fastener first portion with the third releasable fastener second portion.

7. The combination of claim 1, wherein the mat is further convertible between the closed mat position and a second closed mat position wherein the mat of the closed mat position is folded on itself.

8. The combination of claim 7, wherein the second mat member is foldable on itself proximate a medial seam extending along the second mat member from the distal end towards the proximal end;

wherein the second mat member has a second mat member first half and a second mat member second half abuttable and releasably connectable to one another along the medial seam; and wherein in the second closed position, the second mat member first half is disconnected from the second mat member second half, second mat member first half and the second mat member second half each fold to abut the first mat member, and the first mat member folds on itself along the medial axis with the first mat member disposed folded between the second mat member first half and the second mat member second half.

9. The combination of claim 8, wherein the medial seam has at least one overlapping seam portion.

10. The combination of claim 7, further comprising a pair of shoulder straps attached to the mat.

11. The combination of claim 10, wherein the pair of shoulder straps are releasably attached to the mat.

12. The combination of claim 1, further comprising:

at least one pair of tent pole receptors connected to the tent membrane or to the mat;

at least one tent pole with a first pole end and a second pole end, the at least one tent pole sized to extend over the mat with the first pole end received in one of the pair of tent pole receptors and the second pole end received in the other of the pair of tent pole receptors with the at least one tent pole engaging the first tent membrane member to maintain the first tent membrane member in an open position wherein the first tent membrane member substantially encloses an open space between the mat and the first tent membrane member.

13. The combination of claim 12, wherein one of the pair of tent pole receptors is attached to the first side portion of the mat and the other one of the pair of tent pole receptors being attached to the second side portion of the mat.

14. The combination of claim 12, wherein one of the pair of tent pole receptors is attached proximate a first corner of the mat and the other one of the pair of tent pole receptors is attached proximate a second corner of the mat located diagonally opposite of the first corner of the mat.

15. The combination of claim 12, wherein the at least one tent pole comprises a first tent pole and a second tent pole, wherein the first tent pole is configured to extend from a first tent pole receptor proximate a first corner of the mat to a second tent pole receptor proximate a second corner of the mat diagonal from the first corner and wherein the second tent pole is configured to extend from a third tent pole receptor proximate a third corner of the mat to a fourth tent pole receptor proximate a fourth corner of the mat diagonal from the third corner.

16. The combination of claim 15, further comprising:

a second storage pouch attached to the mat;

a second tent membrane member disposable within the second storage pouch and having a second lower membrane edge portion corresponding to the first user surface of the mat and a second membrane opening portion corresponding to the plane transverse to the first user surface;

a second releasable fastener first portion disposed along the second lower membrane edge portion;

a second releasable fastener second portion disposed along the first side portion, distal end, and second side portion of the second mat member, the second releasable fastener second portion complementing and connectable to the second releasable fastener first portion, wherein the second tent membrane member is capable of releasably connecting to the mat by engagement of the second releasable fastener first portion with the second releasable fastener second portion;

a third releasable fastener first portion disposed along the membrane opening portion of the first tent membrane member; and a third releasable fastener second portion disposed along the second membrane opening portion of the second tent membrane member, wherein the membrane edge portion of the first tent membrane member is releasably connectable to the second membrane edge portion of the second tent membrane member by engagement of the third releasable fastener first portion with the third releasable fastener second portion.

* * * * *